US009676543B2

(12) United States Patent
Lemnios et al.

(10) Patent No.: US 9,676,543 B2
(45) Date of Patent: Jun. 13, 2017

(54) SHOWER DOOR GLASS PANE PACKAGING ASSEMBLY

(71) Applicant: LIBERTY HARDWARE MFG. CORP., Winston-Salem, NC (US)

(72) Inventors: Christine Lemnios, Greensboro, NC (US); Yinghong Zhang, Guangzhou (CN); Jeanie Matherly, Oak Ridge, NC (US); Matthew Klein, Apex, NC (US); Patrick Boehnen, Summerfield, NC (US); Laura Hawkins, Madison, NC (US); James Allen Austin, III, High Point, NC (US); Earl David Forrest, Asheboro, NC (US); Nathaniel Faltin Dutton Schultz, Charlotte, NC (US); Justin Terrell Torrence, Winston-Salem, NC (US)

(73) Assignee: LIBERTY HARDWARE MFG. CORP., Winston-Salem, NC (US)

( * ) Notice: Subject to any disclaimer, the term of this patent is extended or adjusted under 35 U.S.C. 154(b) by 0 days.

(21) Appl. No.: 14/167,235

(22) Filed: Jan. 29, 2014

(65) Prior Publication Data

US 2015/0210469 A1 Jul. 30, 2015

(51) Int. Cl.
*B65D 85/48* (2006.01)
*A47K 3/30* (2006.01)
(Continued)

(52) U.S. Cl.
CPC ..... *B65D 85/48* (2013.01); *A47K 3/30* (2013.01); *B65D 5/4204* (2013.01);
(Continued)

(58) Field of Classification Search
CPC ..... A47K 3/30; B65D 25/30; B65D 25/54; B65D 85/48; B65D 5/46;
(Continued)

(56) References Cited

U.S. PATENT DOCUMENTS 475,948 A 5/1892 Pease
739,027 A 9/1903 Raum
(Continued)

FOREIGN PATENT DOCUMENTS

CA 2505163 A1 10/2006
CN 201375303 U 9/2013
(Continued)

OTHER PUBLICATIONS

European Search Report for corresponding Application No. 15152924.5, mailed Jul. 8, 2015, 9 pages.
(Continued)

*Primary Examiner* — Anthony Stashick
*Assistant Examiner* — Mollie Impink
(74) *Attorney, Agent, or Firm* — Brooks Kushman P.C.; Lora Graentzdoerffer

(57) ABSTRACT

A packaging assembly is provided with a base that is sized to receive at least one shower door glass pane. At least one shower door glass pane is received within the base. A handle is mounted to the base. A plurality of projections extends from a bottom surface of the base to rest upon an underlying support surface and to reduce friction between the packaging assembly and the underlying support surface. The base includes a box with an opening formed in opposed surfaces of the box to expose a portion of the at least one shower door glass pane.

18 Claims, 6 Drawing Sheets

(51) Int. Cl.

| | |
|---|---|
| ***B65D 25/28*** | (2006.01) |
| ***B65D 81/05*** | (2006.01) |
| ***B65D 81/113*** | (2006.01) |
| ***B65D 5/42*** | (2006.01) |
| ***B65D 5/46*** | (2006.01) |
| ***B65D 5/50*** | (2006.01) |
| *B65D 25/54* | (2006.01) |

(52) U.S. Cl.

CPC ..... *B65D 5/46008* (2013.01); *B65D 5/509* (2013.01); *B65D 25/2805* (2013.01); *B65D 81/053* (2013.01); *B65D 81/057* (2013.01); *B65D 81/058* (2013.01); *B65D 81/113* (2013.01); *B65D 25/54* (2013.01); *B65D 2203/00* (2013.01); *B65D 2581/053* (2013.01); *B65D 2581/055* (2013.01); *B65D 2585/642* (2013.01)

(58) Field of Classification Search

CPC ..... B65D 5/46008–5/46064; B65D 5/4204; B65D 73/0042; B65D 73/0085

USPC ..... 206/769, 462, 463, 779, 780

See application file for complete search history.

(56) References Cited

U.S. PATENT DOCUMENTS

| | | | | |
|---|---|---|---|---|
| 805,570 | A | 11/1905 | Maldaner | |
| 865,465 | A | 9/1907 | Williams | |
| 949,915 | A | 2/1910 | Schreiber | |
| 1,242,872 | A | 10/1917 | Saunders | |
| 1,530,211 | A | 3/1925 | Siemnash | |
| 1,688,255 | A | 10/1928 | Wasch | |
| 1,736,828 | A | 11/1929 | Lobban | |
| 1,841,620 | A | 1/1932 | McCoy | |
| 1,927,837 | A | 9/1933 | Kingdon | |
| 2,113,288 | A | 4/1938 | Berger | |
| 2,223,770 | A | 12/1940 | Nagle | |
| D129,731 | S | 9/1941 | Luttrell | |
| 2,290,104 | A | 7/1942 | Larson | |
| 2,501,609 | A * | 3/1950 | Midouhas | B65D 5/5021 206/449 |
| D165,358 | S | 12/1951 | Baldwin | |
| 2,879,899 | A | 3/1959 | Shenkin | |
| 2,884,136 | A | 4/1959 | Leighton | |
| 2,937,743 | A | 5/1960 | Buttery et al. | |
| 2,944,679 | A | 7/1960 | Rubenstein | |
| 2,950,001 | A | 8/1960 | Bucko | |
| 3,033,356 | A | 5/1962 | Meyerson | |
| 3,121,511 | A | 2/1964 | Whitehead | |
| 3,175,694 | A | 3/1965 | Reibold et al. | |
| 3,347,357 | A | 10/1967 | De Soto et al. | |
| 3,359,573 | A | 12/1967 | Casebolt | |
| 3,361,330 | A | 1/1968 | Arneson | |
| 3,385,451 | A | 5/1968 | Anderson | |
| D211,321 | S | 6/1968 | Ullmann | |
| 3,388,787 | A | 6/1968 | Growney | |
| 3,468,593 | A | 9/1969 | Catlett | |
| 3,517,459 | A | 6/1970 | Schupper | |
| 3,517,801 | A | 6/1970 | Cote | |
| D224,692 | S | 8/1972 | Gray | |
| 3,732,633 | A | 5/1973 | Margolis et al. | |
| D227,351 | S | 6/1973 | Winton | |
| 3,777,883 | A | 12/1973 | Hackenberg | |
| 3,777,896 | A | 12/1973 | Ehrlich | |
| 3,889,813 | A | 6/1975 | Wright | |
| 3,935,949 | A | 2/1976 | Cohen | |
| D240,503 | S | 7/1976 | Crescenzi | |
| 4,105,125 | A | 8/1978 | Magness | |
| 4,109,786 | A | 8/1978 | Roccaforte et al. | |
| 4,145,849 | A | 3/1979 | Shindoll et al. | |
| 4,256,043 | A | 3/1981 | Ovitz, III | |
| D259,161 | S | 5/1981 | Thauer | |
| 4,315,569 | A * | 2/1982 | Jaeschke | B65D 5/4204 206/304 |
| 4,342,268 | A | 8/1982 | Grava | |
| 4,378,905 | A | 4/1983 | Roccaforte | |
| 4,385,687 | A | 5/1983 | Dutcher | |
| 4,429,791 | A * | 2/1984 | Ruppel | B65D 85/48 206/453 |
| 4,634,010 | A | 1/1987 | Otema | |
| 4,705,175 | A | 11/1987 | Howard et al. | |
| 4,720,876 | A | 1/1988 | Tomei et al. | |
| 4,750,609 | A | 6/1988 | Felis | |
| 4,762,235 | A | 8/1988 | Howard et al. | |
| 5,031,781 | A | 7/1991 | Price et al. | |
| D319,934 | S | 9/1991 | Terrell et al. | |
| D323,986 | S | 2/1992 | Ferrero | |
| 5,111,943 | A | 5/1992 | Ramey | |
| D332,744 | S | 1/1993 | McCooey | |
| 5,234,113 | A | 8/1993 | Ramey | |
| D343,075 | S | 1/1994 | Cappel, III | |
| 5,297,685 | A | 3/1994 | Ramey | |
| 5,305,898 | A | 4/1994 | Merl | |
| D349,458 | S | 8/1994 | Verdaguer | |
| 5,346,076 | A | 9/1994 | Hart | |
| 5,348,167 | A | 9/1994 | Jensen | |
| 5,368,486 | A | 11/1994 | Kurzman | |
| 5,372,278 | A | 12/1994 | Leight | |
| D355,586 | S | 2/1995 | Wang | |
| 5,467,915 | A * | 11/1995 | Mattson | A45C 13/26 215/396 |
| 5,503,278 | A | 4/1996 | Ishmael | |
| 5,509,541 | A | 4/1996 | Merl | |
| D372,816 | S | 8/1996 | Rose et al. | |
| 5,547,053 | A * | 8/1996 | Liang | A45C 13/262 16/113.1 |
| D377,144 | S | 1/1997 | Sawa | |
| 5,675,936 | A | 10/1997 | Kurth et al. | |
| D392,820 | S | 3/1998 | Shanahan et al. | |
| 5,769,247 | A | 6/1998 | Merl | |
| D396,805 | S | 8/1998 | Broyles | |
| 5,822,810 | A | 10/1998 | Chen | |
| 5,823,339 | A | 10/1998 | Dunham et al. | |
| 5,848,446 | A | 12/1998 | DeBraal | |
| 5,860,526 | A | 1/1999 | Burke, Jr. | |
| D405,369 | S | 2/1999 | Dohner | |
| 5,887,782 | A * | 3/1999 | Mueller | B65D 5/0227 229/117 |
| D409,858 | S | 5/1999 | Reed | |
| 5,941,384 | A | 8/1999 | Schonhardt et al. | |
| D417,978 | S | 12/1999 | Reed | |
| D425,972 | S | 5/2000 | Smale | |
| 6,102,206 | A | 8/2000 | Pride | |
| 6,102,502 | A | 8/2000 | Melillo et al. | |
| 6,105,796 | A | 8/2000 | Buchanan et al. | |
| 6,170,675 | B1 | 1/2001 | Follman et al. | |
| 6,182,738 | B1 | 2/2001 | Chen | |
| 6,250,044 | B1 | 6/2001 | Funk et al. | |
| D451,801 | S | 12/2001 | Schillinger | |
| 6,340,092 | B1 | 1/2002 | McGrath, Jr. | |
| D454,067 | S | 3/2002 | Schoening et al. | |
| 6,389,991 | B1 | 5/2002 | Morrisson | |
| D461,974 | S | 8/2002 | Hayden | |
| 6,461,705 | B2 * | 10/2002 | Eichhorn | B44C 1/14 428/13 |
| 6,467,856 | B1 | 10/2002 | Chang et al. | |
| 6,484,890 | B1 | 11/2002 | Miller | |
| D466,804 | S | 12/2002 | Solland | |
| D469,349 | S | 1/2003 | Meeker et al. | |
| 6,594,973 | B1 | 7/2003 | Alpert et al. | |
| D482,265 | S | 11/2003 | Wicha | |
| 6,672,546 | B2 | 1/2004 | Calleja | |
| 6,681,445 | B2 | 1/2004 | Huang | |
| 6,701,672 | B2 | 3/2004 | Teubert et al. | |
| 6,811,046 | B2 | 11/2004 | Stein | |
| 6,895,714 | B2 | 5/2005 | Teubert et al. | |
| D507,741 | S | 7/2005 | Lu et al. | |
| 6,913,151 | B2 | 7/2005 | Stevenson | |
| 6,935,514 | B2 | 8/2005 | Lackey et al. | |
| 7,137,172 | B2 | 11/2006 | Elmer | |
| 7,150,361 | B2 | 12/2006 | Calleja | |

(56) References Cited

U.S. PATENT DOCUMENTS

| | | | |
|---|---|---|---|
| 7,178,681 | B2 | 2/2007 | Libman |
| 7,264,126 | B1 | 9/2007 | Bergeron |
| 7,273,084 | B2 | 9/2007 | Chen |
| 7,346,939 | B2 | 3/2008 | Perry |
| D588,905 | S | 3/2009 | Meeks et al. |
| D593,409 | S | 6/2009 | Blick |
| D594,742 | S | 6/2009 | Meier et al. |
| 7,562,949 | B1 | 7/2009 | Nielsen |
| D600,110 | S | 9/2009 | Cain |
| 7,637,059 | B2 | 12/2009 | Chang et al. |
| D607,724 | S | 1/2010 | Dreier et al. |
| 7,748,527 | B2 | 7/2010 | Wisecarver et al. |
| 7,762,508 | B2 | 7/2010 | Xu |
| 7,828,151 | B2 | 11/2010 | Murdoch et al. |
| 7,841,048 | B2 | 11/2010 | Tsai |
| 7,900,784 | B1 | 3/2011 | Weigand et al. |
| D639,652 | S | 6/2011 | Abdalkhani et al. |
| 7,962,998 | B2 | 6/2011 | Proctor et al. |
| D652,717 | S | 1/2012 | Shimoyama et al. |
| D660,988 | S | 5/2012 | Amend |
| 8,191,707 | B2 | 6/2012 | McDonald et al. |
| D668,540 | S | 10/2012 | Lutzig |
| 8,312,998 | B2 | 11/2012 | Theisen |
| D685,260 | S | 7/2013 | Thielemier |
| 8,490,331 | B2 | 7/2013 | Quesada |
| D689,360 | S | 9/2013 | Adams |
| D690,592 | S | 10/2013 | Ding |
| D690,593 | S | 10/2013 | Kaps et al. |
| D694,099 | S | 11/2013 | Ensslen, III et al. |
| D699,563 | S | 2/2014 | McAdam |
| 8,707,475 | B2 | 4/2014 | Johnson et al. |
| D706,626 | S | 6/2014 | Lazar |
| D709,363 | S | 7/2014 | Boehnen et al. |
| 8,789,899 | B2 | 7/2014 | Pirro et al. |
| D710,713 | S | 8/2014 | Fath |
| 8,915,381 | B2 | 12/2014 | Brozak et al. |
| 2001/0002660 | A1 | 6/2001 | Riga et al. |
| 2001/0054258 | A1 | 12/2001 | Becken |
| 2002/0134030 | A1 | 9/2002 | Conway |
| 2002/0144375 | A1 | 10/2002 | Drucker et al. |
| 2002/0157318 | A1 | 10/2002 | Teubert et al. |
| 2003/0019982 | A1 | 1/2003 | Wing et al. |
| 2003/0047528 | A1 | 3/2003 | Stein |
| 2004/0159049 | A1 | 8/2004 | Teubert et al. |
| 2004/0177437 | A1 | 9/2004 | Perry |
| 2004/0238465 | A1 | 12/2004 | Mercure |
| 2004/0245195 | A1 | 12/2004 | Pride |
| 2005/0006332 | A1 | 1/2005 | Stein |
| 2005/0115202 | A1 | 6/2005 | Mertz, II et al. |
| 2005/0115860 | A1 | 6/2005 | Mertz, II et al. |
| 2005/0236299 | A1* | 10/2005 | Weber ..... B65D 75/54 206/775 |
| 2006/0043032 | A1 | 3/2006 | McHugh |
| 2006/0196838 | A1 | 9/2006 | Mercure et al. |
| 2006/0208150 | A1 | 9/2006 | Elmer et al. |
| 2007/0045204 | A1 | 3/2007 | Huard et al. |
| 2007/0295680 | A1 | 12/2007 | Budge et al. |
| 2008/0073469 | A1 | 3/2008 | Mushan et al. |
| 2008/0148639 | A1 | 6/2008 | Jakob-Bamberg et al. |
| 2008/0148692 | A1 | 6/2008 | Wisecarver et al. |
| 2008/0277363 | A1 | 11/2008 | McDonough |
| 2009/0115299 | A1 | 5/2009 | Ricereto |
| 2010/0107497 | A1 | 5/2010 | Hulst et al. |
| 2010/0181267 | A1 | 7/2010 | Theisen |
| 2011/0035871 | A1 | 2/2011 | Seymour et al. |
| 2011/0113547 | A1 | 5/2011 | O'Connell |
| 2012/0005822 | A1 | 1/2012 | Daubmann et al. |
| 2012/0036628 | A1 | 2/2012 | O'Connell |
| 2012/0233926 | A1 | 9/2012 | Chang et al. |
| 2012/0259743 | A1 | 10/2012 | Pate, Jr. |
| 2013/0140319 | A1 | 6/2013 | Tam et al. |
| 2013/0161276 | A1 | 6/2013 | Breeden et al. |
| 2013/0325670 | A1 | 12/2013 | Austin, III et al. |
| 2014/0032447 | A1 | 1/2014 | Fisher |
| 2014/0173990 | A1 | 6/2014 | Schachter et al. |
| 2014/0237715 | A1 | 8/2014 | Wei |
| 2014/0250795 | A1 | 9/2014 | Wei |
| 2014/0259363 | A1 | 9/2014 | Ball et al. |
| 2014/0290001 | A1 | 10/2014 | Hasegawa |
| 2014/0319988 | A1 | 10/2014 | Dietz et al. |
| 2014/0331564 | A1 | 11/2014 | Wei |
| 2015/0096117 | A1 | 4/2015 | Forrest et al. |
| 2015/0208875 | A1 | 7/2015 | Austin, III et al. |
| 2015/0210113 | A1 | 7/2015 | Yang |

FOREIGN PATENT DOCUMENTS

| | | | |
|---|---|---|---|
| CN | 204326804 | U | 5/2015 |
| CN | 204370961 | U | 6/2015 |
| DE | 2149016 | | 4/1973 |
| DE | 9306878 | U1 | 9/1993 |
| DE | 202009004111 | U1 | 8/2009 |
| EP | 1020154 | A2 | 7/2000 |
| EP | 2317052 | A2 | 5/2011 |
| EP | 2774519 | A1 | 9/2014 |
| GB | 827312 | | 2/1960 |
| JP | 2001095657 | A | 4/2001 |
| JP | 2003237846 | A | 8/2003 |
| WO | 2005035396 | A2 | 4/2005 |
| WO | 2005035396 | A3 | 4/2005 |
| WO | 2008076224 | A1 | 6/2008 |
| WO | 2008133531 | A1 | 11/2008 |
| WO | 2009029358 | A1 | 3/2009 |

OTHER PUBLICATIONS www.thermatru.com/trade-professional/dpprgallerdisplays.aspx, "Door Gallery Displays", Jul. 10, 2010, 31 pages.

http://www.johnsonhardware.com/doordisplay.htm, "Johnson Hardware Door Panel Display Unit", Dec. 16, 2010, 2 pages.

Quality Craft, "Installation Manual Shower Unit", Model No. 961WUX006WHI, Mar. 9, 2011, 14 pages.

U.S. Appl. No. 14/167,230, entitled "Shower Door Assembly Display", filed Jan. 29, 2014, 17 pages.

U.S. Appl. No. 29/480,762, entitled "Shower Door Display", filed Jan. 29, 2014, 16 pages.

U.S. Appl. No. 29/480,761, entitled "Shower Door Display", filed Jan. 29, 2014, 14 pages.

U.S. Appl. No. 29/480,728, entitled "Door Packaging", filed Jan. 29, 2014, 14 pages.

U.S. Appl. No. 29/480,731, entitled "Handle for Door Packaging", filed Jan. 29, 2014, 7 pages.

U.S. Appl. No. 29/480,730, entitled "Packaging Castors", filed Jan. 29, 2014, 3 pages.

European Extended Search Report for corresponding Application No. 15152924.5, mailed Oct. 1, 2015, 17 pages.

U.S. Appl. No. 14/814,291, entitled "Shower Door Guide Assembly", filed Jul. 31, 2013, 23 pages.

* cited by examiner

SHOWER DOOR GLASS PANE PACKAGING ASSEMBLY

TECHNICAL FIELD

Various embodiments relate to packaging assemblies for shower door glass panes.

BACKGROUND

Conventional packaging assemblies for shower door glass panes include a preassembled shower door assembly or all of the components for a shower door assembly.

SUMMARY

According to at least one embodiment, a packaging assembly is provided with a base that is sized to receive at least one shower door glass pane. At least one shower door glass pane is received within the base. A handle is mounted to the base.

According to at least another embodiment, a packaging assembly is provided with a base that is sized to receive at least one shower door glass pane. A plurality of projections extends from a bottom surface of the base to rest upon an underlying support surface and to reduce friction between the packaging assembly and the underlying support surface.

According to at least another embodiment, a packaging assembly is provided with a box sized to receive at least one shower door glass pane. At least one shower door glass pane is received within the box. An opening is formed in opposed surfaces of the box to expose a portion of the at least one shower door glass pane.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
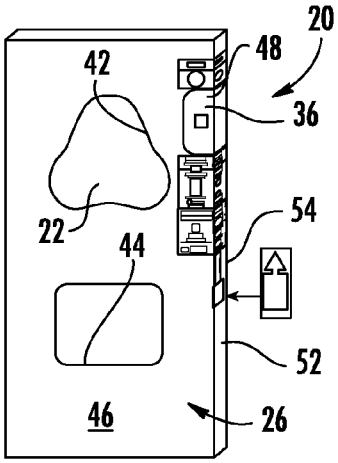
FIG. 1 is a perspective view of a packaging assembly according to an embodiment.
Figure 2:
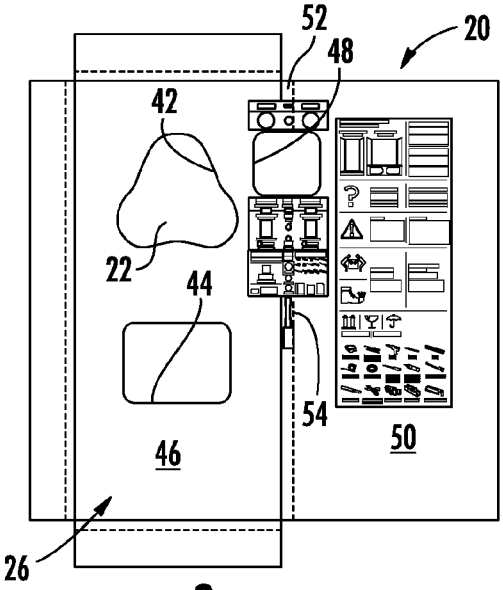
FIG. 2 is an external elevation view of the packaging assembly of FIG. 1, illustrated partially disassembled.
Figure 3:
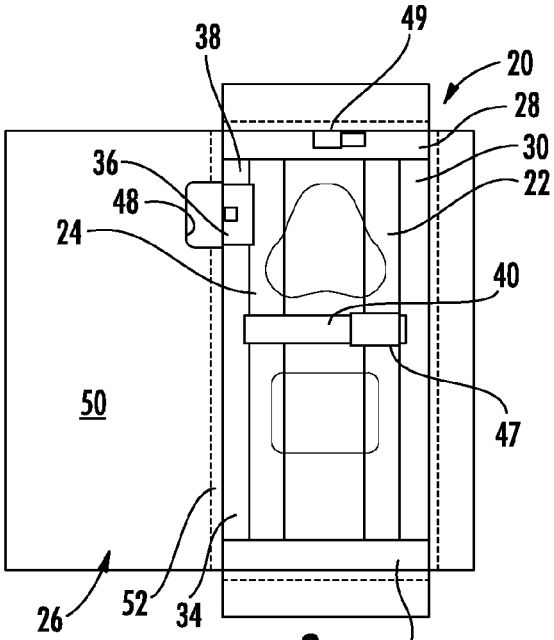
FIG. 3 is an internal elevation view of the packaging assembly of FIG. 1, illustrated partially disassembled.

With reference now to FIGS. 1-3 a packaging assembly is illustrated according to an embodiment and reference generally by numeral 20. The packaging assembly 20 is employed for a shower door 22, and in the depicted embodiment, a pair of shower doors 22, 24. The packaging assembly 20 includes a base, which includes a box 26, which is illustrated unfolded in FIGS. 2 and 3. The box 26 may be formed from cardboard, or any suitable structural packaging material. The shower doors 22, 24 may be formed from any suitable material, such as tempered glass.

The box 26 is sized to receive the shower doors 22, 24, as well as other protective components. Foam perimeter members 28, 30, 32, 34, 36, 38 are provided with grooves for receiving both shower doors 22, 24 and spacing both shower doors 22, 24 apart. Foam cross members 40 may also be provided for supporting the box 26 and the shower doors 22, 24.

A pair of openings 42, 44 is provided in a front panel 46 of the box 26. The openings 42, 44 permit a customer to view portions of the shower doors 22, 24. Conventional shower door packaging is overwrapped thereby obfuscating a view of the shower doors 22, 24. Additionally, openings are typically provided on only one panel, thereby minimizing light to pass through the doors 22, 24.

Sometimes to compensate for prior art packaging, a full shower assembly may be displayed to illustrate an actual appearance of the shower doors. The packaging assembly 20 also includes an opening 48 formed through the front panel 46 and a rear panel 50 of the box 26 to permit light to pass through the shower doors 22, 24. The opening 48 is extended through a peripheral side 52 of the box 26 to further expose the shower doors 22, 24. The exposed portions of the shower doors 22, 24 may be provided without an additional cover or wrapping to provide a typical unobfuscated view of the shower doors 22, 24. Such exposure may eliminate the need for a separate display for an unpackaged shower door, thereby conserving shelf space. The shower doors 22, 24 may be laterally offset so that only one shower door 24 extends through the opening 48.

One of the foam perimeter members 36 is sized to be mounted to the exposed portion of the shower doors 22, 24 at the opening 48 for protecting the shower doors during transportation. The foam perimeter member 36 is formed separate from adjacent foam perimeter members 34, 38 for removal at retail. Therefore, the view of the shower doors 22, 24 is not disrupted by the foam perimeter members 28, 30, 32, 34, 36, 38.

The packaging assembly 20 may also include an instruction sheet 47 and a hardware bag 49 retained within the box 26. In the depicted embodiment, the packaging assembly 20 is less than two inches thick, significantly increasing a Stock Keeping Unit (SKU) count per display unit.

Shower door assemblies are often removed and returned from a point-of-sale display, while customers are deciding on a style, design or the like. Such handling may cause damage to the shower doors. Removal of a shower door assembly may also cause damage to the door. A customer typically grasps the packaging at a height approximate to an elbow of the customer, due to a natural extension of a hand and forearm. Such a height is typically above a center of gravity of the packaging assembly 20. When the customer attempts to slide the packaging assembly 20 with this grasp, the packaging assembly 20 is often tipped onto a corner, thereby distributing a load of the packaging assembly to a focalized region, which may damage the corner.

In order to minimize such handling, a pull handle 54 is provided on the peripheral side 52 of the box 26 at an elevation below the center of gravity of the packaging assembly 20. The handle 54 may be formed from a plastic material for flexibility and structural integrity. By placement of the pull handle 54 below the center of gravity, the customer is encouraged to pull the packaging assembly 20 at a location wherein the packaging assembly 20 is less likely to tip.

Figure 4:
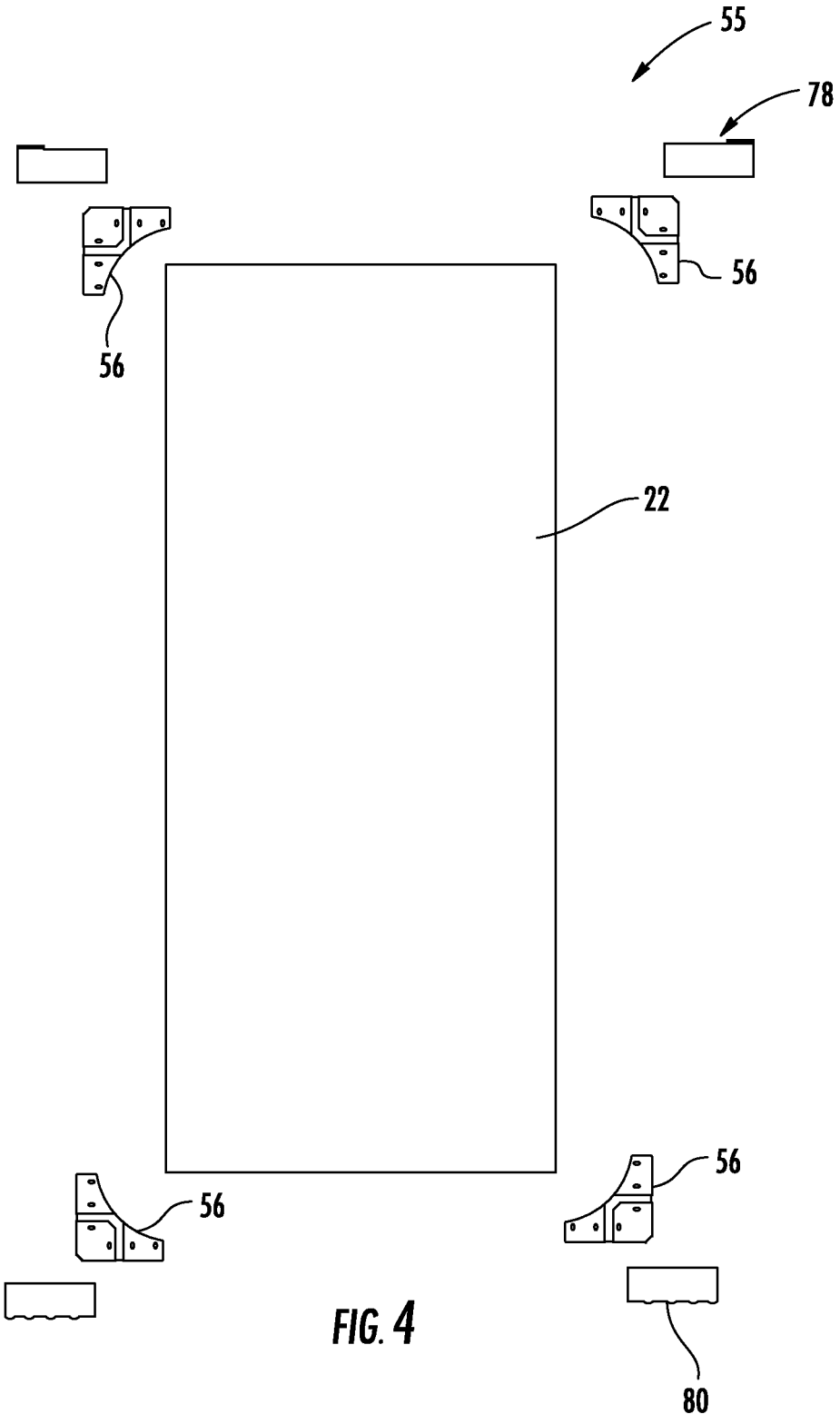
FIG. 4 is a partially exploded view of a packaging assembly according to another embodiment.
Figure 6:
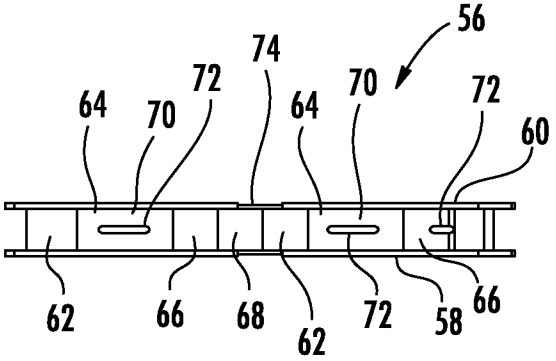
FIG. 6 is a top plan view of the corner protector of FIG. 5.
Figure 5:
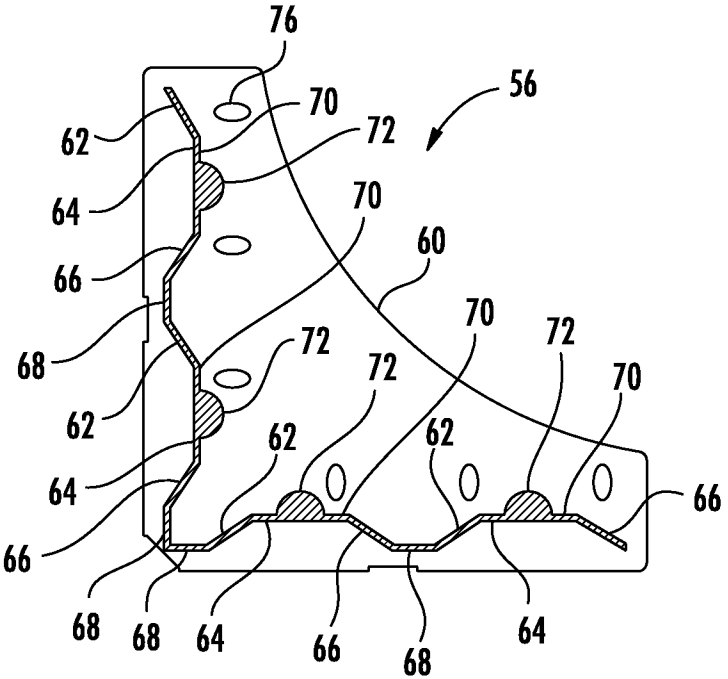
FIG. 5 is a section view of a corner protector of the packaging assembly of FIG. 1, according to an embodiment.

With reference now to FIG. 4, a packaging assembly 55 is illustrated according to another embodiment. The packaging assembly 55 is illustrated without a box 26. The base is provided by four internal corner protectors 56, which are provided to further protect the corners of the shower doors 22, 24. The internal corner protectors 56 can mount directly to the shower doors 22, 24, and may be adhered to the shower doors 22, 24. Referring to FIGS. 5 and 6, the internal corner protectors 56 are formed from a polymeric material and include a pair of spaced apart side walls 58, 60 for covering the corners of the shower doors 22, 24. The side walls 58, 60 are interconnected by a series of webs 62, 64, 66, 68. Contact webs 64 have contact surfaces 70 for receiving the shower doors 22, 24. Angled webs 62, 66 extend away from the contact webs 64 to absorb energy during handling and transportation of the packaging assembly 20. Ribs 72 extend from the contact surfaces 70 to separate the shower doors 22, 24.

The sidewalls 58, 60 of the internal corner protectors 56 include channels 74 to receive a banding material to band the internal corner protectors 56 to the shower doors 22, 24. Additionally shrink wrap may be added to protect surfaces of the shower doors 22, 24. A series of apertures 76 are formed in the sidewalls 58, 60 for fastening to external corner protectors 78, 80, which are illustrated in FIG. 4.

Figure 7:
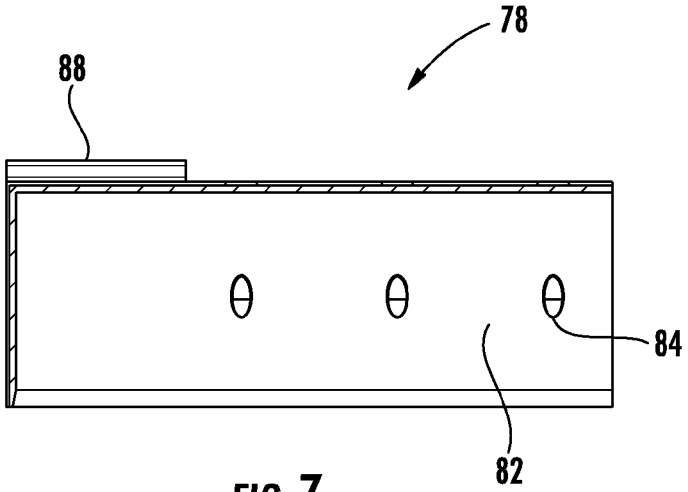
FIG. 7 is a section view of a corner protector of the packaging assembly of FIG. 1, according to another embodiment.
Figure 8:
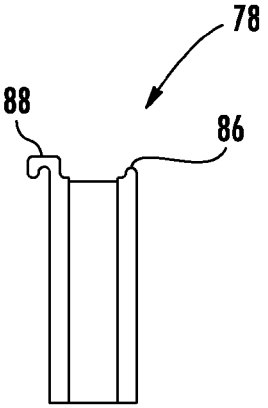
FIG. 8 is a proximal end view of the corner protector of FIG. 7.
Figure 9:
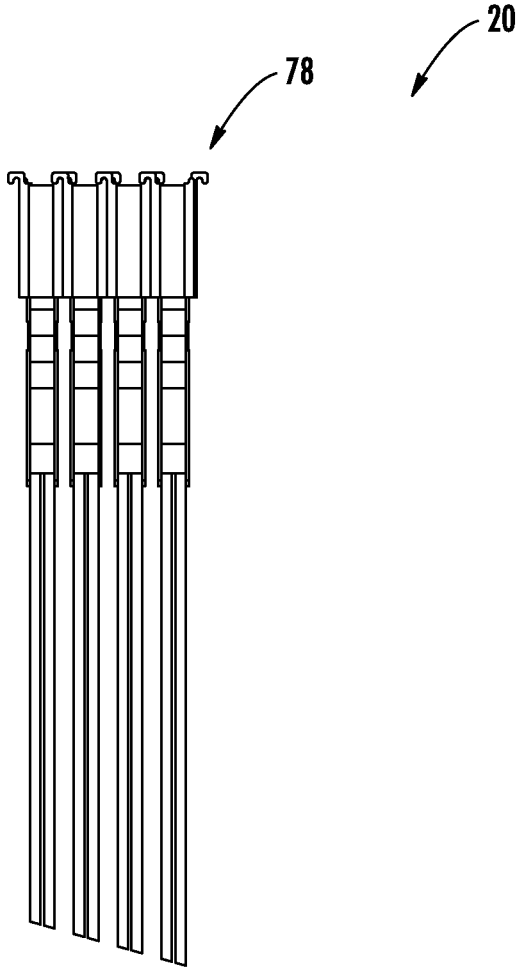
FIG. 9 is a partial side view of a plurality of packaging assemblies of FIG. 1.

The upper external corner protectors 78 are illustrated in greater detail in FIGS. 7 and 8, which may be formed from a polymeric material. The upper external corner protector 78 includes a channel 82 sized to receive an internal corner protector 56. Locking protrusions 84 extend inward to fasten within the apertures 76 in the internal corner protector 56. In FIG. 8 a guide 86 is formed atop the upper external corner protector 78. A track 88 extends from the upper external corner protector 78. Referring to FIG. 9, adjacent packaging assemblies 20 can be aligned so that the tracks 88 receive the guides for maintaining a consistent spacing between the packaging assemblies 20. This arrangement provides adequate spacing while maintaining a uniform appearance at the point-of-sale display.

Figure 10:
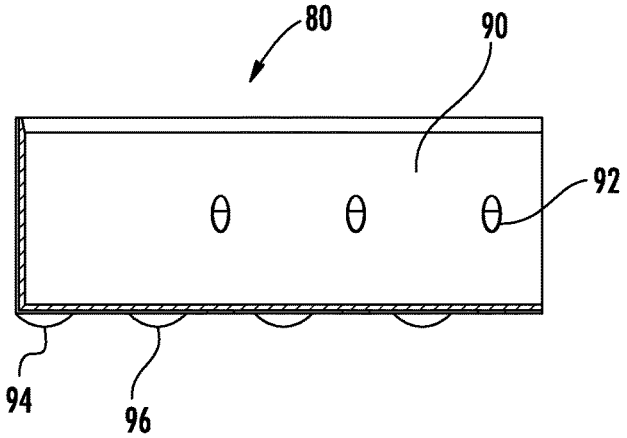
FIG. 10 is a section view of a corner protector of the packaging assembly of FIG. 1, according to another embodiment.
Figure 11:
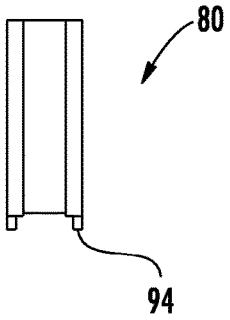
FIG. 11 is a proximal end view of the corner protector of FIG. 10.
Figure 12:
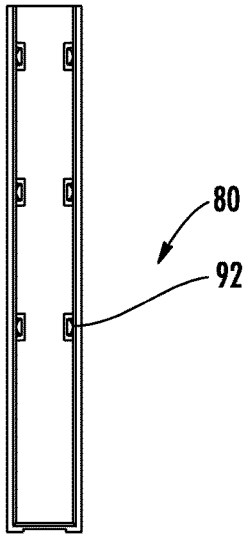
FIG. 12 is a top plan view of the corner protector of FIG. 10.

FIGS. 10-12 illustrate the lower external corner protectors 80 in greater detail, which may also be formed from a polymeric material. The lower external corner protector 80 includes a channel 90 sized to receive an internal corner protector 56. Locking protrusions 92 extend inward to fasten within the apertures 76 in the internal corner protector 56. An array of arcuate projections 94 extend from the lower external corner protectors 80 with peaks 96 to rest upon the floor, or underlying support surface. The projections 94 reduce a contact area for reducing friction between the packaging assembly 20 and the floor. The reduced friction assists in ease of sliding the packaging assembly 20 from the point-of-sale display.

Alternatively, the box 26 may be provided over the internal corner protectors 56. In this example, the locking protrusions 84, 92 of the upper external corner protectors 78 and the lower external corner protectors 80 pierce the box 26 to fasten within the apertures 76 of the internal corner protectors 56.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A packaging assembly comprising:

at least one shower door glass pane;

a box sized to receive the at least one shower door glass pane;

wherein the at least one shower door glass pane has a height, a width and a thickness;

wherein an opening is formed in opposed surfaces of the box to expose a portion of the at least one shower door glass pane to permit a customer to view the portion of the at least one shower door glass pane through the opening;

wherein the opening is formed through a peripheral side of the box exposing the thickness of the at least one shower door glass pane; and a removable packaging member sized to be mounted to the exposed portion of the at least one shower door glass pane for transportation.

2. The packaging assembly of claim 1 wherein the removable packaging member is a foam member.

3. The packaging assembly of claim 2 wherein the foam member is removable from the packaging assembly for display of the at least one shower door glass pane at retail.

4. The packaging assembly of claim 2 wherein the foam member is further defined as a removable foam member;

wherein the packaging assembly further comprises foam perimeter members provided in the box to support and protect the at least one shower door glass pane; and wherein the removable foam member is removable from the foam perimeter members for display of the at least one shower door glass pane at retail.

5. The packaging assembly of claim 1 wherein the packaging assembly further comprises a handle mounted to the box, below a center of gravity of the packaging assembly in an upright orientation of the packaging assembly, to minimize tipping of the packaging assembly.

6. The packaging assembly of claim 5 wherein the handle is mounted to a peripheral side of the box.

7. The packaging assembly of claim 5 wherein the box is formed from cardboard and the handle is formed from a plastic material.

8. The packaging assembly of claim 5 wherein the box comprises at least one corner protector sized to receive the at least one shower door glass pane.

9. The packaging assembly of claim 1 wherein the at least one shower door glass pane comprises a pair of shower door glass panes that are laterally offset relative to one another so that only one of the pair of shower door glass panes extends through the opening formed through the peripheral side of the box.

10. A packaging assembly comprising:

a box sized to receive at least one shower door glass pane;

at least one shower door glass pane received within the box;

wherein an opening is formed in opposed surfaces of the box to expose a portion of the at least one shower door glass pane to permit a customer to view the portion of the at least one shower door glass pane through the opening; and a foam member sized to be mounted to the exposed portion of the at least one shower door glass pane for transportation.

11. The packaging assembly of claim 10 wherein the opening is formed through a peripheral side of the box.

12. The packaging assembly of claim 10 wherein the foam member is removable from the packaging assembly for display of the at least one shower door glass pane at retail.

13. The packaging assembly of claim 10 wherein the foam member is further defined as a removable foam member;

wherein the packaging assembly further comprises foam perimeter members provided in the box to support and protect the at least one shower door glass pane; and wherein the removable foam member is removable from the foam perimeter members for display of a thickness of the at least one shower door glass pane at retail.

14. A packaging assembly comprising:

a box sized to receive at least one shower door glass pane; and at least one shower door glass pane received within the box;

wherein an opening is formed in opposed surfaces of the box to expose a portion of the at least one shower door glass pane to permit a customer to view the portion of the at least one shower door glass pane through the opening;

wherein the opening is formed through a peripheral side of the box; and wherein the at least one shower door glass pane comprises a pair of shower door glass panes that are laterally offset relative to one another so that only one of the pair of shower door glass panes extends through the opening formed through the peripheral side of the box.

15. The packaging assembly of claim 14 wherein the pair of shower door glass panes are exposed without an additional cover.

16. The packaging assembly of claim 14 further comprising a foam member sized to be mounted to the exposed portion of the pair of shower door glass panes for transportation.

17. The packaging assembly of claim 16 wherein the foam member is removable from the packaging assembly for display of the pair of shower door glass panes at retail.

18. The packaging assembly of claim 16 wherein the foam member is further defined as a removable foam member;

wherein the packaging assembly further comprises foam perimeter members provided in the box to support and protect the at least one shower door glass pane; and wherein the removable foam member is removable from the foam perimeter members for display of the pair of shower door glass panes at retail.

* * * * *